US005551564A

United States Patent [19]

Prater et al.

[11] Patent Number: 5,551,564

[45] Date of Patent: Sep. 3, 1996

[54] ROLL PACKAGE CONVERTIBLE TO A DISPENSER

[76] Inventors: James L. Prater, 5031 Williams Dr., Fort Meyers Beach, Fla. 33931; Joseph F. Moore, 1605 Harborough Rd., Richmond, Va. 23233

[21] Appl. No.: 190,268

[22] Filed: Feb. 2, 1994

[51] Int. Cl.[6] ..... B65D 85/67

[52] U.S. Cl. ..... 206/409; 206/37; 206/389; 206/470

[58] Field of Search ..... 206/39, 39.3, 39.5, 206/39.8, 214, 389, 390, 403, 409, 411, 470, 37; 221/25, 70

[56] References Cited

U.S. PATENT DOCUMENTS

| | | | |
|---|---|---|---|
| Re. 26,493 | 12/1968 | Stoker, Jr. . | |
| D. 165,656 | 1/1952 | Lathrop . | |
| D. 201,766 | 7/1965 | Perkins . | |
| D. 263,059 | 2/1982 | Croyle et al. . | |
| D. 293,338 | 12/1987 | Evenson . | |
| 537,524 | 12/1896 | McMaster . | |
| 1,051,198 | 1/1913 | Collins | 206/39.5 X |
| 1,212,349 | 1/1917 | Hardy . | |
| 2,847,118 | 8/1958 | Johnson | 206/39.3 |
| 3,005,580 | 10/1961 | Malia . | |
| 3,403,869 | 10/1968 | Marchisen et al. . | |
| 3,446,343 | 5/1969 | Zimmer et al. . | |
| 3,743,086 | 7/1973 | Aldrich . | |
| 3,857,487 | 12/1974 | Misslin . | |
| 4,279,359 | 7/1981 | Arnold . | |
| 4,531,634 | 7/1985 | Jung-Chi . | |
| 4,676,446 | 6/1987 | Ciocorelli et al. | 206/470 X |
| 4,700,835 | 10/1987 | Rognsvoog, Jr. . | |
| 4,807,753 | 2/1989 | Goldstein | 206/390 |
| 5,358,113 | 10/1994 | Hellenbrand | 206/411 |

FOREIGN PATENT DOCUMENTS

| | | |
|---|---|---|
| 8805197 | 7/1988 | European Pat. Off. . |

*Primary Examiner*—Paul T. Sewell
*Assistant Examiner*—Tara L. Laster
*Attorney, Agent, or Firm*—Roger S. Dybvig

[57] ABSTRACT

A roll package for items such as postage stamps or other labels that is convertible to a dispenser for such items includes a pair of elongate housing parts formed from a single piece of plastic sheet stock and joined along mutually confronting end edges by an integral hinge. When used as a package, a roll of stamps or the like is held within one of the housing parts by a cover sheet. Plural roll packages are formed from a single piece of flat plastic sheet stock and one or more cover sheets, with the individual packages separated from one another by perforated or scored connecting lines. Individual packages can be removed from the sheet of packages by tearing along the connecting lines.

14 Claims, 1 Drawing Sheet

ROLL PACKAGE CONVERTIBLE TO A DISPENSER

FIELD OF THE INVENTION

This invention relates to a roll package that is convertible to a dispenser and more particularly to a roll package for postage stamps or other labels, which is convertible to a dispenser for manually dispensing such items. This invention also relates to sheets of connected such packages and to dispensers formed from such packages.

BACKGROUND OF THE INVENTION

Perforated strips of postage stamps are sold by the United States Postal Service in the form of a roll contained in a transparent blister package having a roll chamber extending laterally from a four-sided frame area which is approximately one and one-half inches square. A cover sheet sealed to the frame area holds the stamp roll in the roll chamber. The stamp roll is relatively tightly wound and the outermost end stamp is adhered to the roll by an adhesive strip. The purchaser or user may use a knife or a scissors to cut through the roll chamber or the cover sheet to remove the roll. It may then be placed in a suitable dispenser from which one may tear one or more stamps as needed along lines of perforations between them. Other labels are also packaged in strips that are formed into rolls from which they may be dispensed one or more at a time.

SUMMARY OF THE INVENTION

A principal object of the invention is to provide an improved roll package for postage stamps or the like items which is convertible to a dispenser for such items. A corresponding object is to provide an improved roll dispenser that is assembled from such a package. Another object is to provide such a package that is so inexpensive that it can be considered to be disposable, although it may be sufficiently durable that it can be reused for many rolls.

Another object of this invention is to provide a unitary assembly of packages for stamp rolls or the like items and which are convertible to dispensers for such items, from which assembly individual roll packages can be readily removed at the time of sale.

For convenience, the remainder of this Summary and the descriptions that follow refer to and describe stamp packages convertible to stamp dispensers, but it is to be understood that the packages could be used for other purposes.

In accordance with this invention, a postage stamp package which is convertible to a postage stamp dispenser is provided which comprises two, integrally-formed, elongate housing parts formed, preferably by a vacuum forming operation, from a single piece of thin, flat, plastic sheet stock. The two housing parts are hinged together by an integral hinge that joins them together along an end edge of each housing part. Here it may be noted that the ends of the housing parts joined by the integral hinge are referred to herein as the "hinged ends" whereas the opposite ends are referred to herein as the "free ends." Also, it should be recognized that terms such as "side," "end," "upwardly," "downwardly," "top" and "bottom" are used in a relative sense herein and not in an absolute sense. The housing parts are, for convenience, termed the "upper housing" and the "lower housing" herein.

Each housing part includes a base wall from which a tray-like body portion extends. The body portion of the upper housing has a flat top wall, a pair of sidewalls extending downwardly from the respective side edges of the top wall, and a pair of end walls extending downwardly from the respective end edges of the top wall. The body portion of the lower housing has a flat bottom wall, a pair of sidewalls extending upwardly from the respective side edges of the bottom wall, and a pair of end walls extending upwardly from the respective end edges of the bottom top wall. The upper housing opens downwardly and has a generally cylindrical, upwardly-projecting, roll chamber formed adjacent the hinged end of its base wall. The roll chamber serves as the storage container for a stamp roll until the package is sold and converted to a dispenser. The end wall at the opposite, free end of the upper housing is adapted to provide a slot or stamp-dispensing orifice through which the stamps can be dispensed. The lower housing opens upwardly. Up to the time of first use, the two housing parts are spaced apart about the axis of the integral hinge by substantially 180 degrees and the bottom of the upper housing is covered by a removable cover sheet to retain the stamp roll within the roll chamber. To convert the package to a dispenser, the cover sheet is removed from the upper housing, the stamp roll removed from the package so that the adhesive tape can be removed from the stamp roll, and, after the stamp roll is returned to the roll chamber, the outermost end of the strip of stamps is extended along the bottom surface of the top wall of the upper housing and through the dispensing orifice or slot provided in its free end wall. With the stamp roll within the roll chamber, the two housing parts are folded about the integral hinge toward one another so that the bottom wall, sidewalls and end walls of the lower housing are inserted into the bottom of the upper housing and frictionally held therein by the mutual engagement of interfitting surfaces along their sides and ends. When thus assembled, the lower housing is partly received within the upper housing so that the bottom of the roll chamber is closed by one end of the lower housing bottom wall and a stamp delivery channel is formed between the mutually confronting top and bottom walls at their free ends. An access opening is preferably provided in the bottom wall of the lower housing that exposes the strip of stamps so that the strip can be advanced along the stamp delivery channel toward the dispensing orifice. In other embodiments, the access opening may be formed in the top wall of the upper housing. In operation, one or more stamps is removed from the dispenser and separated from the roll by tearing the strip against a margin of the dispensing orifice or a nearby edge of the dispenser along one of the lines of perforations that are provided between each pair of stamps. An additional stamp or additional stamps can then be advanced through the dispensing orifice by manually engaging the portion of the strip exposed through the access hole. The dispenser is discarded when the roll is fully used up. However, one could reuse the dispenser if desired.

Plural stamp roll packages of this invention are preferably formed from a single piece of flat plastic sheet stock, with the individual packages separated from one another by thin, perforated or scored connecting lines which are weak and may be easily torn along. Several sheets of stamp roll packages can be packaged in a single container, with individual sheets removed in preparation for the sale of the individual packages. At the time of sale, individual packages can be removed from the sheet of packages by tearing along the appropriate connecting lines.

Other objects and advantages will become apparent from the following drawing and description.

DETAILED DESCRIPTION

Figures 1, 2, 3, 4, 5, 6, 7:
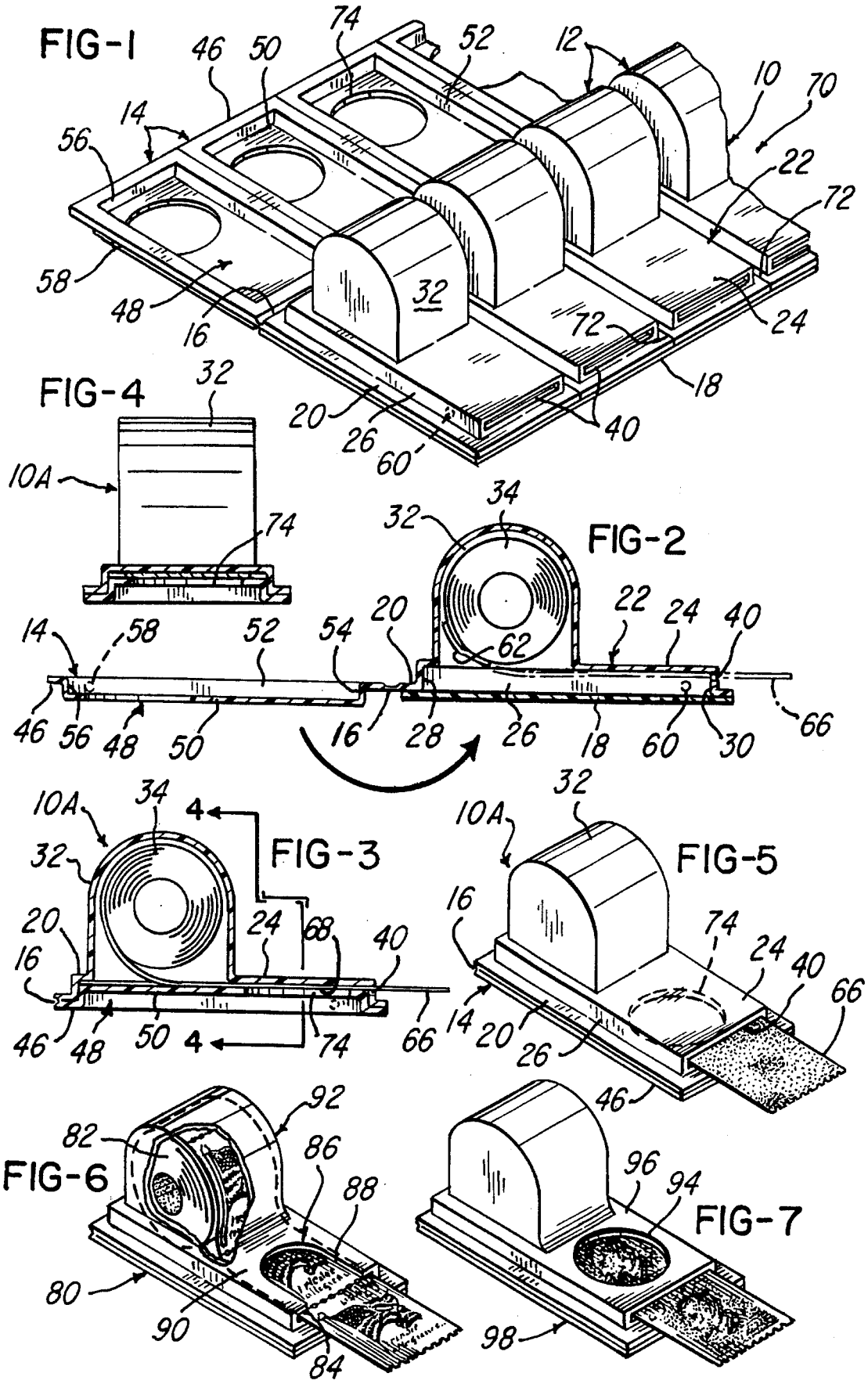
FIG. 1 is a fragmentary perspective view of a sheet of plural, interconnected, stamp packages of this invention.
FIG. 2 is a longitudinal cross sectional view of a single package of FIG. 1 as it would be delivered to a purchaser at the time of purchase and illustrates, by phantom lines, how the user may extend the outer end of the strip to and through the stamp dispensing orifice.
FIG. 3 is a longitudinal cross sectional view of the package of FIG. 2 after it has been converted for use as a dispenser.
FIG. 4 is a transverse cross sectional view taken along lines 4—4 of FIG. 3.
FIG. 5 is a perspective view of the package of FIGS. 2, 3 and 4 after it has been converted for use as a dispenser.
FIG. 6 is a perspective view, with parts broken away and parts shown in cross section, of a second embodiment of a stamp dispenser in accordance with this invention.
FIG. 7 is a perspective view of a third embodiment of a stamp dispenser in accordance with this invention.

With reference first to FIG. 2, a stamp roll package embodying the present invention is generally designated 10 and comprises an upper housing 12, a lower housing 14, an integral hinge 16 integrally connecting the two housing parts 12 and 14, and a cover sheet 18 which may be heat sealed to the bottom of the upper housing 14.

The upper housing 12 comprises a base wall 20 and an upper, tray-like body, generally designated 22, extending upwardly from the center of the base wall 20. Upper body 22 comprises a flat top wall 24, a pair of sidewalls 26 extending downwardly from the respective side edges of the top wall 24, and a pair of end walls 28 and 30 extending downwardly from the respective end edges of the top wall 24. The end of the upper housing 12 nearest the hinge 16 is referred to herein as the "hinged end" and the opposite end is referred to herein as the "free end."

The upper tray-like body 22 opens downwardly and has a generally cylindrical, upwardly-projecting, roll chamber 32 formed adjacent the hinged end of its top wall 24. In use, the roll chamber 32 serves as a storage container for a stamp roll 34 until the package 10 is sold and converted to a dispenser, designated 10A in FIGS. 3, 4 and 5, as will be described below. Stamp roll 34 is retained within the storage container by the separate cover sheet 18. The free end wall 30 has a stamp dispensing orifice 40, which may be formed during manufacture of the package 10. Optionally, it may be partly formed during manufacture, as by perforating, scoring, or creating a projection (not shown) in the free end wall 30, and completed after purchase by punching out or cutting away parts of the end wall 30 with a knife.

The lower housing 14 comprises a base wall 46 and a lower, tray-like body, generally designated 48, extending downwardly from the center of the base wall 46. Lower body member 48 comprises a flat, generally rectangular bottom wall 50, a pair of sidewalls 52 extending upwardly from the respective side edges of the bottom wall 50, and a pair of end walls 54 and 56 extending upwardly from the respective end edges of the bottom wall 50. The end of the lower housing 14 nearest the hinge 16 is referred to herein as the "hinged end" and the opposite end is referred to herein as the "free end." The lower housing 14 opens upwardly in the original or "package" configuration of the package 10, as shown in FIG. 2.

For reasons which will become apparent, the length and width of the tray-like body 48 are each slightly less than the length and width of the upper body 22, so that the lower body 48 can be partly nested within the upper body 22. Small projections 58 are formed near the free ends of the lower housing sidewalls 52 and mating recesses 60 are formed near the free end of the upper housing sidewalls 26. The projections 58 snap into the recesses 60 when the lower housing body 48 enters the upper housing body 22 in order to snap-fit the upper and lower housings 12 and 14 together and thereby maintain their interfitting relationship.

The base walls 20 and 46 are mutually coplanar, these being unchanged parts of the original flat sheet of plastic from which the housing parts 12 and 14 are made. Hinge 16 is formed from a single web of the plastic material integrally joined to the mutually confronting end edges of the base walls 20 and 46. As will become apparent, the hinge 16 may only be used one time, or a few times, so that it is not necessary to form the housings 12 and 14 from a plastic material, such as polypropylene, which can withstand numerous repeated hinging actions. Other plastic materials, which are preferably transparent, may be used.

With reference to FIG. 1, the stamp roll package 10 is preferably formed as part of a sheet 70 of plural stamp roll packages 10, comprising rows of packages 10 arrayed side by side. Although not illustrated in FIG. 1, there could be many other packages 10 arranged end to end with the illustrated packages 10. With continued reference to FIG. 1, the housing parts 12 and 14 of all of the packages 10 are formed from a single piece of flat plastic sheet stock, using known plastic materials and known vacuum forming techniques. After inserting the stamp rolls 34 in the various roll chambers of the packages 10, each entire row of upper housings could be covered by a single strip of plastic film or the like to form the cover sheets 18. The entire sheet 70 can then be subjected to another operation by which the individual packages 10 are partly separated from one another by connecting lines 72 which are rendered weak, as by being made thin, scored, or perforated, and which extend along the adjacent side edges of the packages (and also along the adjacent end edges if there are more than one row of packages formed by the sheet 70). The sheet 70 could be packaged with other sheets (not shown) for delivery to the retail outlet for the packages 10. Individual packages 10 can be removed from the sheet 70 by tearing along appropriate connecting lines 72 at the time of sale to a purchaser.

Before a package 10 is converted for use as a dispenser 10A, as shown in FIGS. 1 and 2, the two housing parts 12 and 14 are spaced apart about the axis of the integral hinge 16 by substantially 180 degrees. To convert the package 10 to a dispenser 10A, the cover sheet 18 is removed, the stamp roll 34 removed so that the piece of adhesive tape, designated 62, which adheres the outermost stamp to the packaged roll 34 may be removed from the stamp roll 34, and, with the stamp roll 34 returned to the roll chamber 32, the outermost end of the strip of stamps, designated 66, is extended, as indicated by phantom lines in FIG. 2, along the bottom surface of the top wall 22 of the upper housing 12 and through the dispensing orifice 40 in its free end wall 30. With the stamp roll 34 within the roll chamber 32, the two housing parts 12 and 14 are folded about the integral hinge 16 toward one another so that the lower housing 14 is partly inserted into the upper housing 12, as shown in FIGS. 3 and 4, and snap-fit together by the interengagement of the projections 58 and recesses 60 (FIGS. 2 and 6). When thus assembled, the lower housing 14 is partly received within the upper housing 12 so that the bottom of the roll chamber 32 is closed by the hinge end of the lower housing bottom wall 50 and a stamp delivery channel 68 is formed between the free ends of the mutually confronting upper housing top wall 24 and the lower housing bottom wall 50. An access opening 74 is preferably provided in the bottom wall 50 of the lower housing 14. Access opening 74 exposes the strip of stamps 66 so that the strip can be advanced, as shown by phantom lines in FIG. 2 and by full lines in FIG. 3, along the stamp delivery channel 68 toward the stamp dispensing orifice 40. Access opening 74 is sufficiently large that one may insert a thumb or finger through it and into engagement with the strip of stamps in the delivery channel 68.

In use, as is evident from FIG. 5, a purchaser may insert a thumb or finger into the access opening 74 and push the strip of stamps along the stamp delivery channel 68 and out through the dispensing orifice 40. One or more stamps can be severed from the roll 34 by tearing the perforated line between two adjacent stamps against a margin of the dispensing orifice 40 or against an adjacent edge surface. When the roll 34 is entirely used up, the dispenser 10A, being inexpensive, can simply be discarded. Of course, it could be reused if desired.

FIG. 6 shows a second embodiment of a dispenser, generally designated 80, in which a stamp roll 82 is loaded reversely from the stamp roll 34 of the first embodiment, so that the stamps exit a dispensing orifice 84 facing upwardly whereas the adhesive surface of the stamps faces upwardly in the first embodiment, as illustrated in FIG. 5. In FIG. 6, the access opening, designated 86, is in the form of a slot 88 that extends along the top of the top wall 90 of the upper housing 92 and opens to the dispensing orifice 84. FIG. 7 shows a related embodiment in which a circular access opening 94 is formed within the margins of an upper housing top wall 94. The assembly and operation of the dispensers of FIGS. 6 and 7 will be evident from the description of the package 10 and the dispenser 10A of the first embodiment. In a further modification, the bottom wall (not shown) of the lower housing 98 shown in FIG. 7, could also have an access opening (not shown) so that the strip of stamps could be gripped between the thumb and forefinger of the user and pulled toward the dispensing orifice.

While the invention has been particularly shown and described with reference to the preferred embodiments thereof, it will be understood by those skilled in the art that various alterations in form and detail may be made therein without departing from the spirit and scope of the invention.

We claim:

1. A package for a roll formed from a strip of labels, which package is convertible to a dispenser, comprising:

an upper housing formed from a single piece of plastic, said upper housing having a chamber having a roll formed from a strip of labels disposed therein;

a lower housing formed from said piece of plastic;

an integral hinge formed from said piece of plastic that joins said housings to one another along an edge of each housing; and a separate, removable cover sheet underlying and attached to said upper housing for retaining said roll in said chamber for delivery to a purchaser, one of said housings defining a dispensing orifice, said lower housing having surfaces (a) adapted to frictionally interfit within said upper housing following removal of said cover sheet, and (b) insertable into said upper housing following removal of said cover sheet by folding said housings toward another about the axis of said hinge, and said upper housing and said lower housing having surface portions which, when said surfaces of said lower housing are inserted into said upper housing, define a delivery channel extending from said chamber to said dispensing orifice.

2. The package of claim 1 wherein said dispensing orifice is located in said upper housing.

3. The package of claim 1 further comprising an access opening in one of said housings through which one may extend a thumb or finger to advance the strip toward said dispensing opening.

4. The package of claim 3 wherein said access opening is located in said upper housing.

5. The package of claim 3 wherein said access opening is located in said lower housing.

6. The package of claim 1 wherein said upper housing and said lower housing are mutually spaced by approximately 180 degrees about the axis of said hinge.

7. The package of claim 1 wherein said upper housing comprises a body having a flat top wall, said top wall having marginal side and end edges, and further having sidewalls and end walls extending downwardly from the side and end edges of said top wall, said chamber extending upwardly from said top wall within the confines of said side and end edges, and wherein said lower housing comprises a body having a flat bottom wall having marginal side and end edges, and further having upwardly-extending sidewalls and end walls, the length and width of said lower housing relative to the length and width of said upper housing being such that said lower housing can be nested within said upper housing.

8. A sheet of plural packages for individual rolls formed from a strip of labels, which packages are convertible to dispensers, said packages being connected along weak connecting lines that enable them to be easily separated from one another, each of said packages comprising:

an upper housing formed from a single piece of plastic, said upper housing having a chamber; having a roll formed from a strip of labels disposed therein:

a lower housing formed from said piece of plastic;

an integral hinge formed from said piece of plastic that joins said housings to one another along an edge of each housing; and a separate, removable cover sheet underlying and attached to said upper housing for retaining said roll in said chamber for delivery to a purchaser, one of said housings defining a dispensing orifice, said lower housing having surfaces (a) adapted to frictionally interfit within said upper housing following removal of said cover sheet, and (b) insertable into said upper housing following removal of said cover sheet by folding said housings toward another about the axis of said hinge, and said upper housing and said lower housing having surface portions which, when said surfaces of said lower housing are inserted into said upper housing, define a delivery channel extending from said chamber to said dispensing orifice.

9. The sheet of claim 8 wherein said dispensing orifice is located in said upper housing.

10. The sheet of claim 8 further comprising an access opening in one of said housings through which one may extend a thumb or finger to advance the strip toward said dispensing opening.

11. The sheet claim 10 wherein said access opening is located in said upper housing.

12. The sheet of claim 10 wherein said access opening is located in said lower housing.

13. The sheet of claim 8 wherein said upper housing and said lower housing are mutually spaced by approximately 180 degrees about the axis of said hinge.

14. The sheet of claim 8 wherein said upper housing comprises a body having a flat top wall, said top wall having marginal side and end edges, and further having sidewalls and end walls extending downwardly from the side and end edges of said top wall, said chamber extending upwardly from said top wall within the confines of said side and end edges, and wherein said lower housing comprises a body having a flat bottom wall having marginal side and end edges, and further having upwardly-extending sidewalls and end walls, the length and width of said lower housing relative to the length and width of said upper housing being such that said lower housing can be nested within said upper housing.

* * * * *